United States Patent [19]

Anselm

[11] Patent Number: 4,666,410

[45] Date of Patent: May 19, 1987

[54] MOUNTING ARRANGEMENT FOR MARINE PROPULSION DEVICE

[75] Inventor: Michael C. Anselm, Gurnee, Ill.

[73] Assignee: Outboard Marine Corporation, Waukegan, Ill.

[21] Appl. No.: 671,902

[22] Filed: Nov. 16, 1984

[51] Int. Cl.[4] ..... B63H 21/26

[52] U.S. Cl. ..... 440/61; 440/53; 248/642

[58] Field of Search ..... 440/53, 57, 61, 900; 248/642

[56] References Cited

U.S. PATENT DOCUMENTS

| | | | |
|---|---|---|---|
| 2,729,186 | 1/1956 | Kloss | 440/53 |
| 2,953,335 | 9/1960 | Kiekhaefer | 440/61 |
| 3,250,501 | 5/1966 | Alexander | 248/642 |
| 3,718,110 | 2/1973 | Blanchard | 440/61 |
| 4,354,847 | 10/1982 | Blanchard | 440/61 |
| 4,504,237 | 3/1985 | Blanchard | 440/61 |

*Primary Examiner*—Galen Barefoot
*Assistant Examiner*—Thomas J. Brahan
*Attorney, Agent, or Firm*—Michael, Best & Friedrich

[57] ABSTRACT

A marine propulsion device for use with a boat including a transom. The device comprises a transom bracket adapted to be fixedly connected to the transom, a swivel bracket pivotally connected to the transom bracket for vertical swinging movement about a horizontal tilt axis, and a kingpin having upper and lower ends fixed to the swivel bracket and a central portion intermediate the ends. The device also includes a propulsion unit including a powerhead, a driveshaft housing including an upper surface fixedly connected to the powerhead, a lower surface, and a vertical bore receiving the central portion of the kingpin to facilitate horizontal swinging movement on the driveshaft housing relative to the swivel bracket. The propulsion unit also includes a gearcase fixedly connected to the lower surface of the driveshaft housing, and a propeller rotatably carried by the gearcase.

11 Claims, 5 Drawing Figures

MOUNTING ARRANGEMENT FOR MARINE PROPULSION DEVICE

BACKGROUND OF THE INVENTION

This invention relates to marine propulsion devices and, more particularly, to arrangements for mounting marine propulsion devices, such as outboard motors, on a boat transom.

Attention is directed to the following U.S. patents which illustrate mounting arrangements for marine propulsion devices: Strang U.S. Pat. No. 3,841,257, issued Oct. 15, 1974, and Ferguson U.S. Pat. No. 4,449,945, issued May 22, 1984.

SUMMARY OF THE INVENTION

This invention provides a marine propulsion device for use with a boat including a transom. The device comprises a transom bracket adapted to be fixedy connected to the transom, a swivel bracket pivotally connected to the transom bracket for vertical swinging movement about a horizontal tilt axis, and a kingpin having upper and lower ends fixed to the swivel bracket and a central portion intermediate the ends. The device also includes a propulsion unit incuding a powerhead, a driveshaft housing including an upper surface fixedly connected to the powerhead, a lower surface, and a portion having a vertical bore receiving the central portion of the kingpin to facilitate horizontal swinging movement of the driveshaft housing relative to the swivel bracket. The propulsion unit also includes a gearcase fixedly connected to the lower surface of the driveshaft housing, and a propeller rotatably carried by the gearcase.

This invention also provides a marine propulsion device for use with a boat including a transom, the marine propulsion device comprising a transom bracket adapted to be fixedly connected to the tansom, and a swivel bracket pivotally connected to the tansom bracket for vertical swinging movement about a horizontal tilt axis. The swivel bracket includes vertically spaced first and second portions. The device also includes a propulsion unit including a powerhead, a driveshaft housing including an upper surface fixedly connected to the powerhead, a lower surface, and a portion located between the vertically spaced first and second swivel bracket portions, a grearcase fixedly connected to the lower surface of the driveshaft housing, and a propeller rotatably carried by the gearcase. The device also includes means for pivotally connecting the driveshaft housing portion to the swivel bracket for horizontal swinging movement of the propulsion unit about a vertical steering axis.

In one embodiment of the invention, the device further includes bushing means located in the vertical bore in the driveshaft housing and between the kingpin and the swivel bracket for further facilitating pivotal movement of the propulsion unit relative to the swivel bracket.

In one embodiment, means is provided for selectively effecting axial movement of the driveshaft housing relative to the kingpin to permit vertical movement of the propulsion unit relative to the swivel bracket. Such means can include a pair of vertically spaced bushings located in the driveshaft housing bore and cooperating therewith to define a chamber, a piston connected to the kingpin and located in the chamber to divide it into upper and lower variable volume subchambers, and a hydraulic system for selectively pumping a hydraulic fluid into and draining the hydraulic fluid from one of the subchambers.

In one embodiment, one of the swivel brackets and the driveshaft housing further includes an indentation having horizontally spaced walls and the other of the driveshaft housing and the swivel bracket includes a stop located in the indentation and movable between a first angled swing position abutting one of the walls, and a second angled swing position abutting the other wall.

This invention also provides a boat including a transom including a rear surface, and a marine propulsion device comprising a transom bracket fixedly mounted on the transom rear surface, a swivel bracket pivotally connected to the transom bracket for vertical swinging movement about a horizontal tilt axis, a trim cylinder piston rod assembly including a first end connected to the tansom bracket and a second end connected to the swivel bracket, a kingpin having upper and lower ends connected to the swivel bracket and a central portion intermediate the ends, and a propulsion unit. The propulsion unit includes a powerhead and a driveshaft housing including an upper surface fixedly connected to the powerhead, a lower surface, and a vertical bore receiving the central portion of the kingpin to facilitate horizontal swinging movement of the driveshaft housing relative to the swivel bracket. The propulsion unit further includes a gearcase fixedly connected to the lower surface of the driveshaft housing, and a propeller rotatably carried by the gearcase.

One of the principal features of the invention is the provision of a marine propulsion device including a propulsion unit having a driveshaft housing and a mounting arrangement for mounting the driveshaft housing on a boat transom in a manner such that the center of gravity of the propulsion unit is lower than for conventional mounting arrangements, thereby providing safer boat operation and reducing the airdrag caused by the propulsion unit. Such a feature is particularly advantageous in boat racing applications.

Another of the principal features of the invention is the provision of such a mounting arrangement including a transom bracket which is mounted on a boat transom and means for selectively effecting vertical movement of the driveshaft housing relative to the transom bracket.

Other features and advantages of embodiments of the invention will become apparent upon review of the following detailed description, the drawings and the appended claims.

Figure 1:
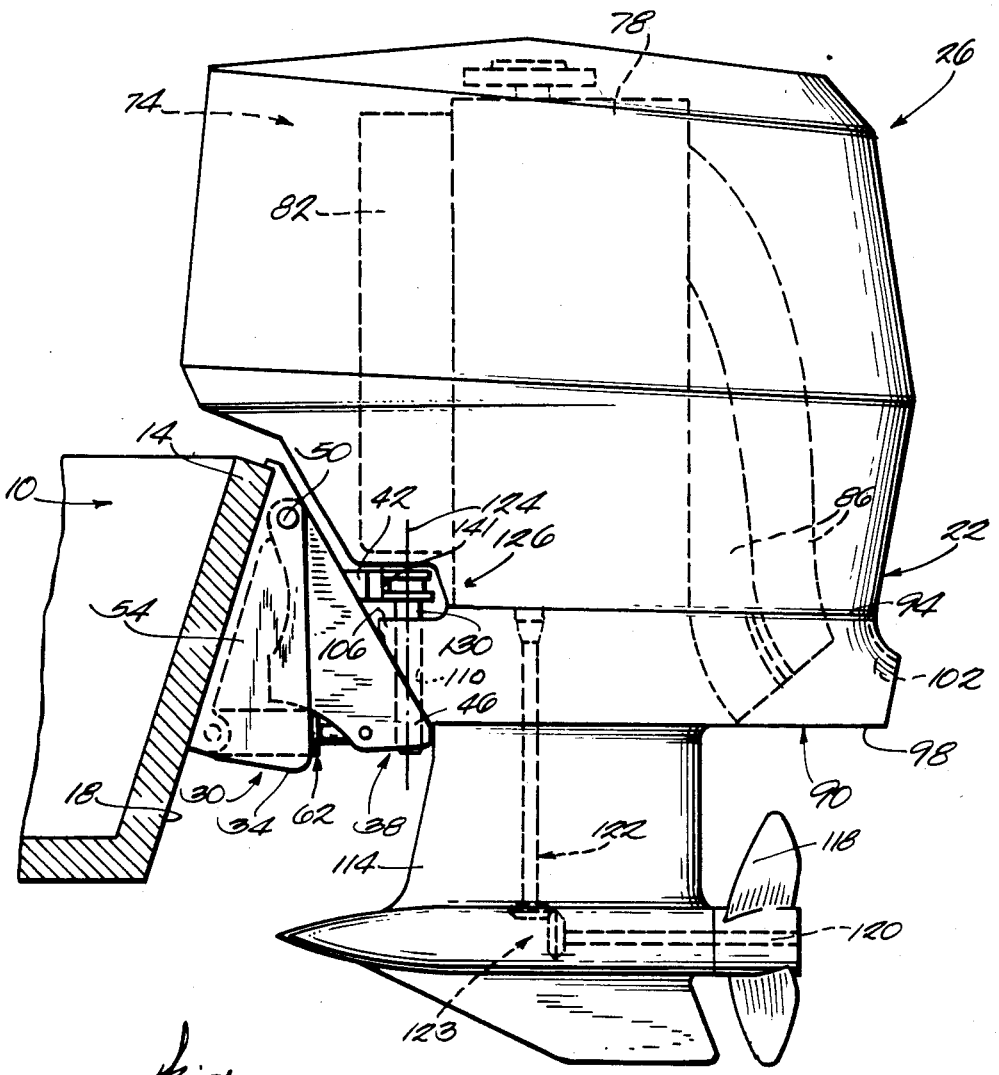
FIG. 1 is a side elevational, partially schematic view of a marine propulsion device which embodies various of the features of the invention.

Before explaining at least one of the embodiments of the invention in detail, it is to be understood that the invention is not limited in its application to the details of construction and the arrangements of the components set forth in the following description and illustrated in the drawings. The invention is capable of other embodiments and of being practiced or carried out in various ways. Also, it is to be understood that the phraseology and terminology employed herein is for purposes of description and should not be regarded as limiting.

DESCRIPTION OF THE PREFERRED EMBODIMENT

Illustrated in FIG. 1 is a boat 10 including a transom 14 having a rearward or rear surface 18 and a marine propulsion device 22 mounted on the transom 14 of the boat 10. The marine propulsion device 22 includes a propulsion unit in the form of an outboard motor 26 and a transom bracket 30 fixedly connected to the transom 14. The transom bracket 30 is mounted on the rear surface 18 of the transom 14 and includes a lower end 34. The marine propulsion device 22 also includes a swivel bracket 38 which includes vertically spaced upper and lower or first and second portions 42 and 46, respectively, and which is pivotally connected to the transom bracket 30 for vertical swinging movement about a horizontal tilt axis 50.

Figure 2:
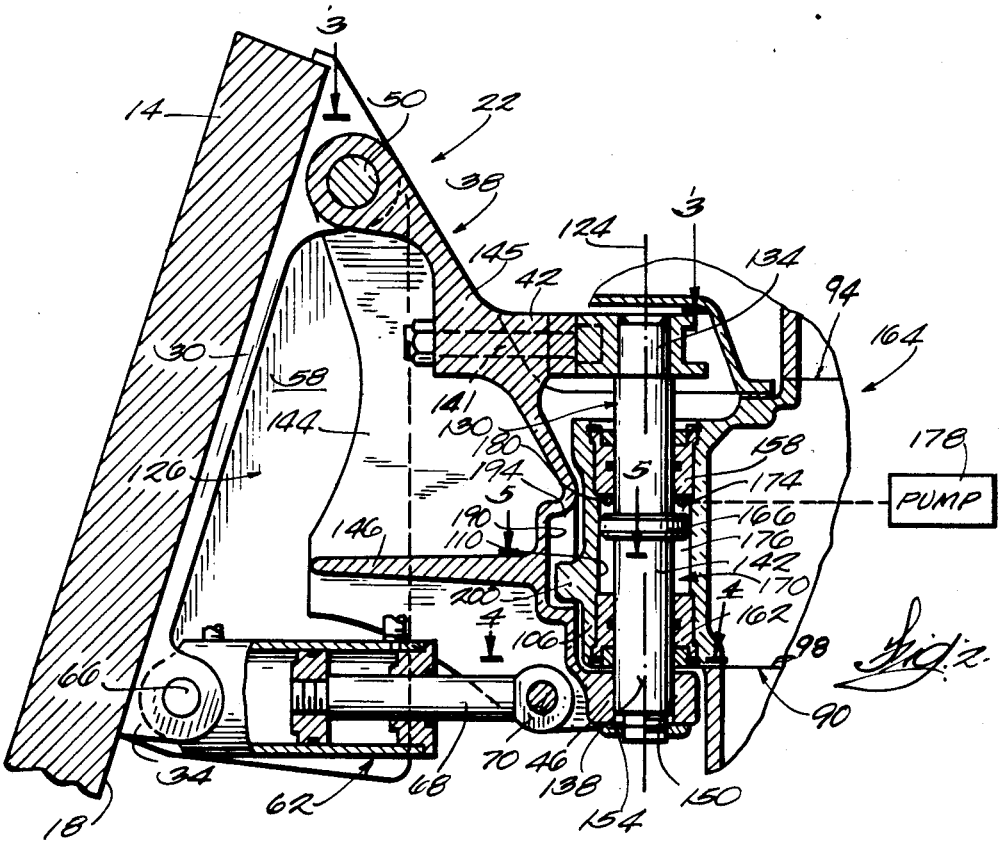
FIG. 2 is an enlarged, cross-sectional view of the mounting arrangment portion of the marine propulsion device illustrated in FIG. 1.

More particularly, the transom bracket 30 includes spaced apart walls 54 and 58, respectively, one wall 54 shown in FIG. 1 and the other wall 58 shown in FIG. 2. When the swivel bracket 38 is received between the walls 54 and 58 of the transom bracket 30, as illustrated in FIGS. 1 and 2, the swivel bracket 38 is provided lateral support by virtue of the sides of the swivel bracket 38 contacting with the walls 54 and 58 of the transom bracket 30.

Figure 4:
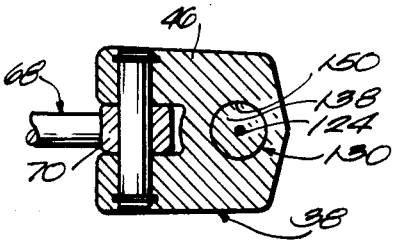
FIG. 4 is a cross-sectional view taken generally along line 4—4 in FIG. 2.

As illustrated in FIGS. 1 and 2, the marine propulsion device 22 also includes means for tilting the swivel bracket 38 relative to the transom bracket 30. The tilting means is in the form of a hydraulic trim cylinder piston rod assembly 62 having a cylinder or first end 66 pivotally connected to the lower end 34 of the transom bracket 30, and a piston rod 68 having a rod or second end 70 pivotally connected to the lower portion 46 of the swivel bracket 38 (See FIG. 4). Extension of the piston rod 68 moves the swivel bracket 38 away from the transom bracket 30, thereby trimming the propulsion unit 26 upwardly, and retraction of the piston rod 68 moves the swivel bracket 38 towards the tansom bracket 30, thereby lowering the proplusion unit 26.

As illustrated in FIG. 1, the propulsion unit 26 includes a powerhead 74 comprising an engine 78 including a bank of carburetors 82 and exhaust passages 86. The propulsion unit 26 also includes a driveshaft housing 90 including an upper surface 94 fixedly connected to the lower end of the powerhead 74 and a lower surface 98. The driveshaft housing 90 includes one or more openings 102 through which the exhaust gases from the engine 78 are exhausted, and a portion 106 which is located between the upper and lower swivel bracket portions 42 and 46, respectively. This driveshaft housing portion 106 includes a vertical bore 110, as more fully explained hereinafter.

The propulsion unit 26 also includes a gearcase 114 fixedly connected to the lower surface 98 of the driveshaft housing 90, and a propeller 118 carried on a propeller shaft 120 rotatably mounted in the gearcase 114. A driveshaft 122 extending through the driveshaft housing 90 and drivingly connected to the engine 78 drives the propeller 118 through a conventional transmission 123.

As illustrated in FIGS. 1 and 2, means 126 is provided for pivotally connecting the propulsion unit 26 to the swivel bracket 38 for horizontal swinging movement of the propulsion unit 26 about a vertical steering axis 124. As illustrated in FIG. 2, such means 126 includes a kingpin 130 including upper and lower ends 134 and 138, respectively, and a central portion 142 intermediate the upper and lower ends. The kingpin central portion 142 is received in the vertical bore 10 in the driveshaft housing 90, and the kingpin axis provides the vertical steering axis 124. The kingpin upper end 134 is fixedly connected to the upper swivel bracket portion 42, and the lower end 138 of the kingpin 130 is fixedly connected to the lower swivel bracket portion 46. More particularly, in the specific embodiment illustrated (FIG. 3), the upper swivel bracket portion 42 includes a yoke shaped member 140 which is welded to the kingpin upper end 134 and which is fixedly connected to the remainder of the swivel bracket 38 by bolts 141. In other embodiments, other suitable means can be used for fastening the upper end 134 of the kingpin 130 to the swivel bracket 38.

Figure 3:
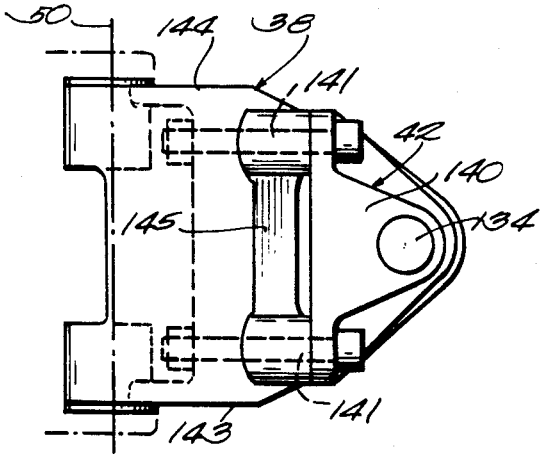
FIG. 3 is a top view taken generally along line 3—3 in FIG. 2.

As illustrated in FIGS. 2 and 3, the swivel bracket 38 includes two horizontally spaced vertical sides 143 and 144, and a web portion 145 extending between the sides 143 and 144 for receiving the mounting bolts 141 for the yoke shaped member 140. The swivel bracket 38 also includes a support wall 146 located intermediate the upper and lower portions of the swivel bracket 38 and extending horizontally between the vertical sides 143 and 144 to provide additional support to the swivel bracket 38.

The lower end 138 of the kingpin 130 is threaded, extends through a bore 150 (see FIGS. 2 and 4) in the lower swivel bracket portion 46, and is fixedly connected to the lower swivel bracket portion 46 by a nut 154 threaded onto the lower kinpin end 138.

Located in the vertical bore 100 and between the driveshaft housing portion 106 and the central portion 142 of the kingpin 130 is bushing means comprising vertically spaced upper and lower bushings 158 and 162, respectively.

Means is also provided for selectively effecting axial movement of the driveshaft housing 90 relative to the kingpin 130 in order to permit vertical movement of the propulsion unit 26 relative to the swivel bracket 38. While various suitable arrangements can be used, in the specific embodiment illustrated, such means comprises a piston 166 fixedly connected to the kingpin 130. The piston 166 is located in a chamber 170 defined between the upper and lower bushings 158 and 162, respectively, and the vertical bore 100 in the driveshaft housing portion 106. The piston 166 divides the chamber 170 into an upper variable volume subchamber 174 and lower variable volume subchamber 176. Hydraulic fluid, supplied by a convention hydraulic pump and valving system 178 (illustrated schematically in FIG. 2), is selectively alternately pumped into and drained from the upper subchamber 174 through a pair of ports 180 opening into the upper subchamber 174.

In operation, when the upper subchamber 174 fills with fluid and increases in volume, the drivehshaft housing 90 moves upwardly relative to the kingpin 130 and the swivel bracket 38. When fluid is drained from the upper chamber 174, the weight of the propulsion unit 26 moves the driveshaft housing 90 downwardly relative to the kingpin 130 and the swivel bracket 38.

Figure 5:
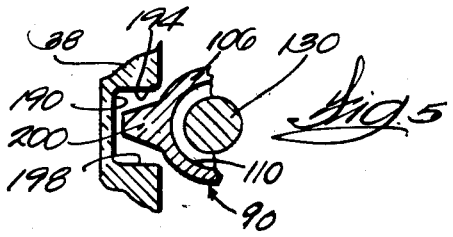
FIG. 5 is a cross-sectional view taken generally along line 5—5 in FIG. 2.

As illustrated in FIGS. 2 and 5, means is also provided for limiting the horizontal swinging movement of the propulsion unit 26 relative to the swivel bracket 38. While various suitable arrangments can be used, in the specific embodiment illustrated, such means comprises an indentation 190 located in the swivel bracket 38 and having horizontally spaced walls 194 and 198, respectively, and a stop 200 which extends from the driveshaft housing portion 106 radially relative to the kingpin 130 and into the indentation 190. The stop 200 rotates with the driveshaft housing 90 about the kingpin 130 and is movable between a first angled swing position wherein the stop 200 abuts one wall 194 of the indentation 190, and a second angled swing position wherein the stop 200 abuts the other wall 198 of the indentation 190. In this manner, the swinging movement of the propulsion unit 26 is limited to about 15° to either side of center in this particular embodiment.

As illustrated in FIG. 2, the depth of the indentation 190 is about three times the depth of the stop 200 in order to permit the stop 200 to move vertically within the indentation 190 as the driveshaft housing 90 moves relative to the kingpin 130.

Various of the features of the invention are set forth in the following claims.

I claim:

1. A marine propulsion device for use with a boat including a transom, said device comprising a transom bracket adapted to be fixedy connected to the transom, a swivel bracket pivotally connected to said transom bracket for vertical swinging movement about a horizontal tilt axis, a kingpin having upper and lower ends fixed to said swivel bracket, and a central portion intermediate said ends, and a propulsion unit including a powerhead, a drive shaft housing including an upper surface fixedly connected to said powerhead, a lower surface, and a portion having a vertical bore receiving said central portion of said kingpin to connect said driveshaft housing to said kingpin so as to facilitate horizontal swinging movement of said driveshaft housing relative to said swivel bracket and being the sole connection between said driveshaft housing and said kingpin affording horizontal swinging movement between said swivel bracket and said driveshaft housing, a gearcase fixedly connected to the lower surface of said driveshaft housing, and a propeller rotatably carried by said gearcase.

2. A marine propulsion device for use with a boat including a transom, said marine propulsion device comprising a transom bracket adapted to be fixedly connected to the transom, a swivel bracket pivotally connected to said transom bracket for vertical swinging movement about a horizontal tilt axis, said swivel bracket including vertically spaced first and second portions, a propulsion unit including a powerhead, a driveshaft housing including an upper surface fixedly connected to said powerhead, a lower surface, and a portion located between said vertically spaced first and second swivel bracket portions, a gearcase fixedly connected to said lower surface of said driveshaft housing, and a propeller rotatably carried by said gearcase, and means for pivotally connecting said driveshaft housing portion to said swivel bracket for horizontal swinging movement of said propulsion unit about a vertical steering axis and including a kinpin connected to said spaced swivel bracket portions and being connected to said driveshaft housing soley be reason of connection of said kingpin to said driveshaft housing portion.

3. A marine propulsion device for use with a boat including a transom, said device comprising a transom bracket adapted to be fixedly connected to said transom, a swivel bracket pivotally connected to said transom bracket for vertical swinging movement about a horizontal tilt axis, said swivel bracket including vertically spaced first and second portions, a propulsion unit including a powerhead and a lower unit, said lower unit including a driveshaft housing including an upper surface supporting said powerhead, a lower surface, and a portion located between said spaced first and second swivel bracket portions and having a vertical bore, a gearcase fixedly connected to the lower surface of said driveshaft housing, and means for pivotally connecting said propulsion unit to said swivel bracket for horizontal movement about a vertical steering axis, said connecting means comprising a kinpin having upper and lower ends respectively fixed to said vertically spaced first and second portions, and a central portion intermediate said ends and received in said vertical bore in said driveshaft housing so as to facilitate horizontal swinging movement of said driveshaft housing relative to said swivel bracket, said receipt of said central part of said kingpin in said vertical bore in said driveshaft housing constituting the sole connection which is provided between said driveshaft housing and said kingpin and which affords rotary movement of said propulsion unit relative to said swivel bracket.

4. A marine propulsion device in accordance with claim 3 further including bushing means located in said vertical bore in said driveshaft housing and between said kingpin and said driveshaft housing for further facilitating pivotal movement of said propulsion unit relative to said swivel bracket.

5. A marine propulsion device for use with a boat including a transom, said device comprising a transom bracket adapted to be fixedly connected to said transom, a swivel bracket pivotally connected to said transom bracket for vertical swinging movement about a horizontal tilt axis and including vertically spaced first and second portions, a propulsion unit including a powerhead and a lower unit comprising a driveshaft housing including an upper surface supporting said powerhead, a lower surface and a portion located between said spaced first and second swivel bracket portions and having a vertical bore, a gearcase fixedly connected to the lower surface of said driveshaft housing, means for pivotally connecting said propulsion unit to said swivel bracket for horizontal movement about a vertical steering axis and comprising a kingpin having upper and lower ends respectively fixed to said vertically spaced first and second portions, and a central portion intermediate said ends and received in said vertical bore in said driveshaft housing to facilitate horizontal swinging movement of said driveshaft housing relative to said swivel bracket, and means for selectively effecting axial movement of said driveshaft housing relative to said kingpin.

6. A marine propulsion device in accordance with claim 5 wherein said means for selectively effecting axial movement of said driveshaft relative to said kingpin comprises a pair of vertically spaced bushings located in said bore and cooperating therewith to define a chamber in said driveshaft housing, a piston fixedly connected to said kingpin and located in said chamber to divide said chamber into upper and lower variable volume subchambers and a hydraulic system for selectively pumping a hydraulic fluid into and draining the hydraulic fluid from one of said subchambers.

7. A marine propulsion device for use with a boat including a transom, said device comprising a transom bracket adapted to be fixedly connected to said transom, a swivel bracket pivotally connected to said transom bracket for vertical swinging movement about a horizontal tilt axis and including vertically spaced first and second portions, a propulsion unit including a powerhead and a lower unit comprising a driveshaft housing including an upper surface supporting said powerhead, a lower surface and a portion located between said spaced first and second swivel bracket portions and having a vertical bore, a gearcase fixedly connected to the lower surface of said driveshaft housing, means for pivotally connecting said propulsion unit to said swivel bracket for horizontal movement about a vertical steering axis and comprising a kingpin having upper and lower ends respectively fixed to said vertically spaced first and second portions, and a central portion intermediate said ends and received in said vertial bore in said driveshaft housing to facilitate horizontal swinging movement of said driveshaft housing relative to said swivel bracket, one of said swivel bracket and said driveshaft housing further incuding an indentation having horizontally spaced walls, and the other said driveshaft housing and said swivel bracket including a stop extending into said indentation and movable between a first angled swing position abutting one of said walls and a second angled swing position abutting said opposite wall.

8. A boat including a transom, and a marine propulsion device comprising a transom bracket fixedly connected to said transom, a swivel bracket pivotally connected to said transom bracket for verticl swinging movement about a horizontal tilt axis, a kingpin having upper and lower ends fixed to said swivel bracket, and a central portion intermediate said ends, and a propulsion unit including a powerhead, a driveshaft housing including an upper surface fixedly connected to said powerhead, a lower surface, and a vertical bore receiving said central portion of said kinpin to connect said driveshaft housing to said kingpin so as to facilitate horizontal swinging movement of said driveshaft housing relative to said swivel bracket and being the sole connection between said driveshaft housing and said kingpin affording horizontal swinging movement of said driveshaft housing relative to said swivel bracket, a gearcase fixedly connected to the lower surface of said driveshaft housing, and a propeller rotatably carried by said gearcase.

9. A boat in accordance with claim 8 wherein said transom includes a rear surface, and wherein said transom bracket is mounted on said transom rear surface, and wherein said marine propulsion device further includes a trim cylinder piston rod assembly including a first end connected to said transom bracket and a second end connected to said swivel bracket.

10. A boat including a transom, and a marine propulsion device comprising a transom bracket adapted to be fixedly connected to said transom, a swivel bracket pivotally connected to said transom bracket for vertical swinging movement about a horizontal tilt axis, said swivel bracket including vertically spaced first and second portions, a propulsion unit including a powerhead, a driveshaft housing including an upper surface fixedly connected to said powerhead, a lower surface, and a portion located between said vertically spaced first and second swivel bracket portions, a gearcase fixedly connected to said lower surface of said driveshaft housing, and a propeller rotatably carried by said gearcase, and means for pivotally connecting said driveshaft housing portion to said swivel bracket for horizontal swinging movement of said propulsion unit about a vertical steering axis and including a kinpin connected to said spaced swivel bracket portions and being connected to said driveshaft housing soley by reason of connection of said kingpin to said driveshaft housing portion.

11. A boat in accordance with claim 10 wherein said transom includes a rear surface, wherein said transom bracket is mounted on said transom rear surface, and wherein said marine propulsion device further includes a trim cylinder piston rod assembly including a first end connected to said transom bracket and a second end connected to said swivel bracket.

* * * * *